United States Patent [19]

Governale

[11] 4,327,535

[45] May 4, 1982

[54] DOOR WITH GLASS PANEL

[75] Inventor: Bernard C. Governale, Duluth, Ga.

[73] Assignee: Peachtree Doors, Inc., Norcross, Ga.

[21] Appl. No.: 123,393

[22] Filed: Feb. 21, 1980

[51] Int. Cl.[3] ..... E06B 3/70; E06B 3/36

[52] U.S. Cl. ..... 52/309.11; 49/501; 52/398; 52/400; 52/455

[58] Field of Search ..... 52/309.9, 309.11, 211, 52/212, 208, 398, 400, 455; 49/501

[56] References Cited

U.S. PATENT DOCUMENTS

| | | | |
|---|---|---|---|
| 2,710,994 | 6/1955 | Mills | 52/208 |
| 3,004,641 | 10/1961 | Johnson | 52/455 |
| 3,153,817 | 10/1964 | Pease, Jr. | 52/802 |
| 3,245,124 | 4/1966 | Faske | 52/211 |
| 3,462,897 | 8/1969 | Weinrott | 52/309.11 X |
| 3,697,633 | 10/1972 | Edgar | 264/46.5 |
| 3,714,751 | 2/1973 | Lackey | 52/208 X |
| 4,084,347 | 4/1978 | Brown | 49/501 |
| 4,152,876 | 5/1979 | Seely | 52/455 |
| 4,266,487 | 5/1981 | Marulic et al. | 52/398 X |

FOREIGN PATENT DOCUMENTS

| | | | |
|---|---|---|---|
| 2258510 | 8/1975 | France | 52/309.9 |

*Primary Examiner*—Alfred C. Perham
*Attorney, Agent, or Firm*—D. Paul Weaver

[57] ABSTRACT

Opposing steel door skins are punched to provide openings of the required size for a specified lite unit. Lite unit locator and retaining flanges are simultaneously formed on the two skins. A prefabricated lite assembly consisting of a pane of glass and surrounding mitered wood frame with sealant is placed between two steel skins in interlocking engagement with the locator and retaining flanges and the door is put through a foaming operation to produce an interior foam core around the margins of the lite assembly or unit.

1 Claim, 6 Drawing Figures

DOOR WITH GLASS PANEL

BACKGROUND OF THE INVENTION

In the prior art, it has been customary to install a lite in an entry door by the following process:

(1) The required openings are punched through both exterior steel door skins and simultaneously locator and retaining flanges are formed around the punched opening, and other customary and necessary metal formations are produced on the skins.

(2) A box-like structure made of wood molding is produced to engage the steel skin flanges. This structure prevents the foam from entering the lite opening during the foaming operation, and thereafter provides support for the glass pane and an area to fasten the glass retaining frame with nails or staples in a subsequent operation.

(3) After the foaming process, the doors are stored until time allows the installation of the glass.

The installation of the glass in the prior art requires the following:

(1) Installation on one side of the glass pane of a retaining frame. This frame has two basic functions: to restrain the glass toward the inside and to cover the glass insulated spacer with a decorative molding. It is installed by first laying down a bead of caulking around the panel opening, pressing the frame into the opening and stapling in place.

(2) The panel is then turned over and another bead of caulking is placed to the inside of the glass retaining frame, and the glass is then placed into the opening. A final bead of caulking is applied around the glass perimeter and another glass retaining frame is pressed into place and stapled.

(3) The panel or lite is cleaned of excess of caulking and stored.

The objective of the present invention is to significantly improve on the above prior art procedure in terms of reducing the number of process steps involved, saving time and labor, lessening storage space and improving the quality of the door. According to the present invention, the door is fabricated according to the following steps:

(1) The required openings and flanges are formed in the two steel skins according to prior art practice.

(2) A prefabricated lite assembly consisting of a pane of glass and a wooden frame made from four mitered profiles with sealant is positioned between the two steel skins and held and locked by the flanges around the skin openings.

(3) The door unit is put through the customary foaming opertion and stored until needed for installation.

Other features and advantages of the invention will become apparent to those skilled in the art during the course of the following description.

DETAILED DESCRIPTION

Figure 1:
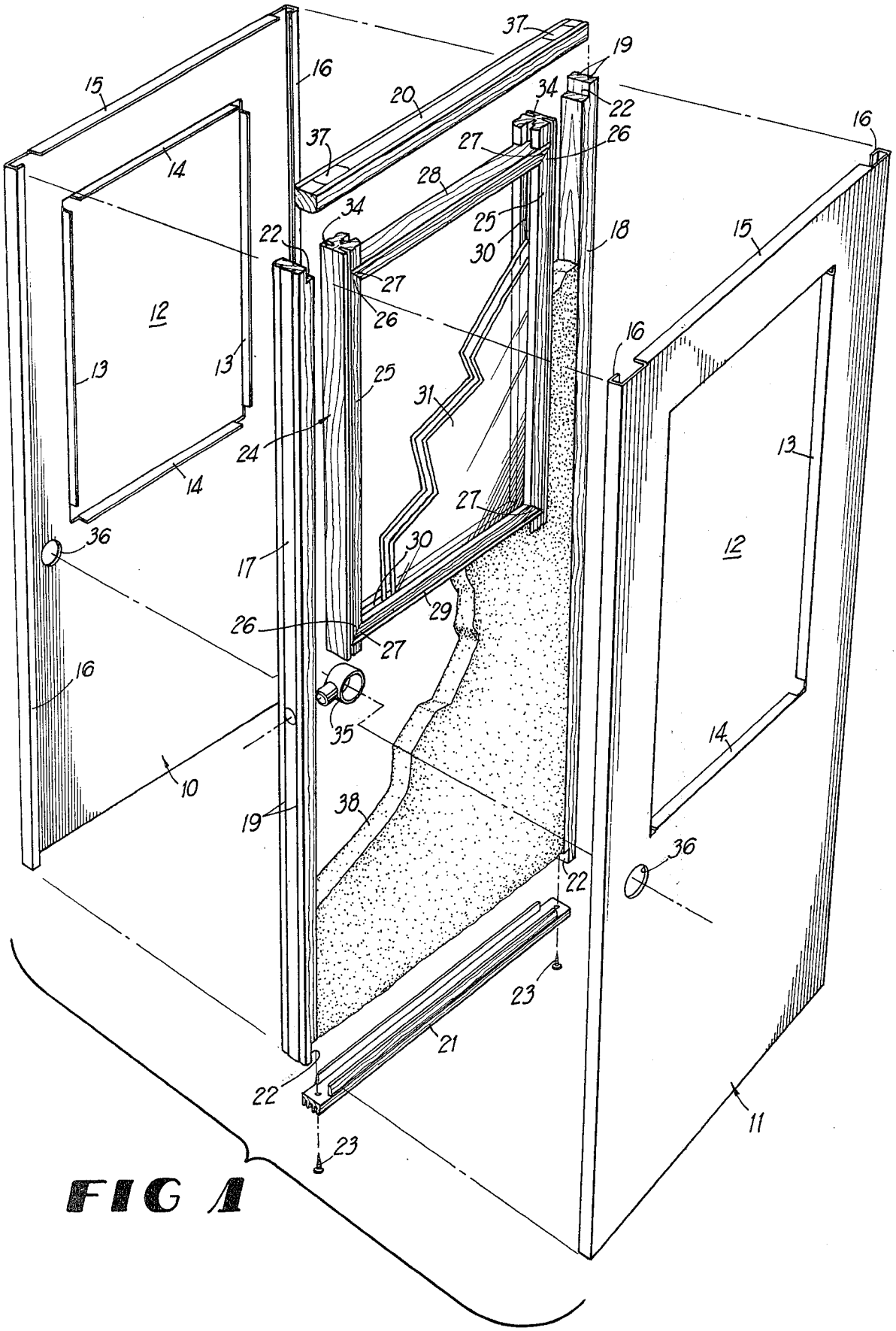
FIG. 1 is an exploded perspective view of the door in accordance with the present invention.

Referring to the drawings in detail, wherein like numerals designate like parts, an opposing pair of steel door panel facings or skins 10 and 11 are punched to provide rectangular lite openings 12 at the desired locations. In the metal punching process, vertical and horizontal narrow flanges 13 and 14 are produced on the steel skins 10 and 11 perpendicular to the planes in which the skins lie and projecting inwardly thereof. Similar top flanges 15 are also formed on the two skins and side vertical edge channels 16 are formed during the metal-working procedure in accordance with known practice.

Figure 4:
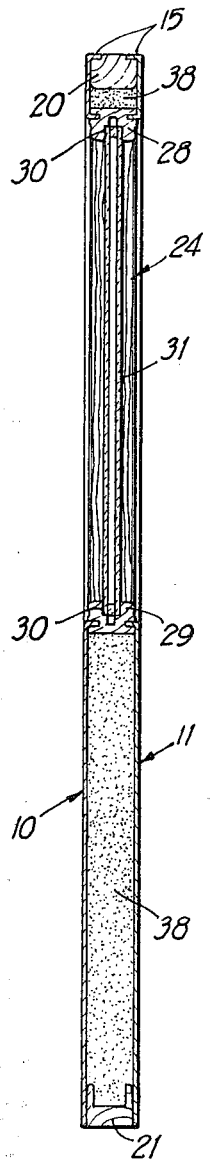
FIG. 4 is a vertical section taken on line 4—4 of FIG. 3.
Figure 5:
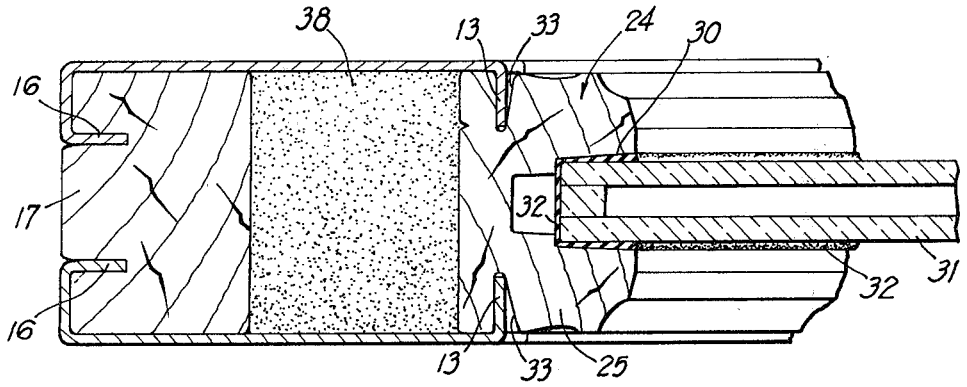
FIG. 5 is an enlarged fragmentary horizontal section taken on line 5—5 of FIG. 3.

Prior to the foaming operation, the door panel is built up by placing lock and hinge stiles 17 and 18 in interlocking engagement with the side channels 16 of skins 10 and 11, as best shown in FIG. 5, the outer sides of the stiles being provided with continuous longitudinal grooves 19 to permit this engagement. Similarly, a door panel top rail 20 and bottom sweep 21 with screws are engaged with notches 22 in the ends of stiles 17 and 18 with the top flanges of the two skins overlapping the top rail 20 lockingly, as best shown in FIG. 4. The screws 23 secure the sweep 21 to the stiles.

In accordance with a major aspect of the method, a prefabricated lite assembly 24 is now prepared for placement between the two skins 10 and 11 prior to the foaming operation. This prefabricated assembly or unit consists of a wooden rectangular frame whose vertical side members 25 are provided near their tops and bottoms with locking miter recesses 26 to receive lockingly the mitered ends 27 of top and bottom horizontal frame members 28 and 29.

Each of the four frame members is provided on its interior side with a channel passage 30 running for its entire length to thereby form in the prefabricated frame a continuous interior channel passage. In accordance with an orderly assembly line procedure, a glass lite or pane 31, which may be of the dual thickness insulating type, has its edges engaged in the channel passage of the frame members with a suitable glazing tape 32 placed around the edges of the glass pane.

Figure 3:
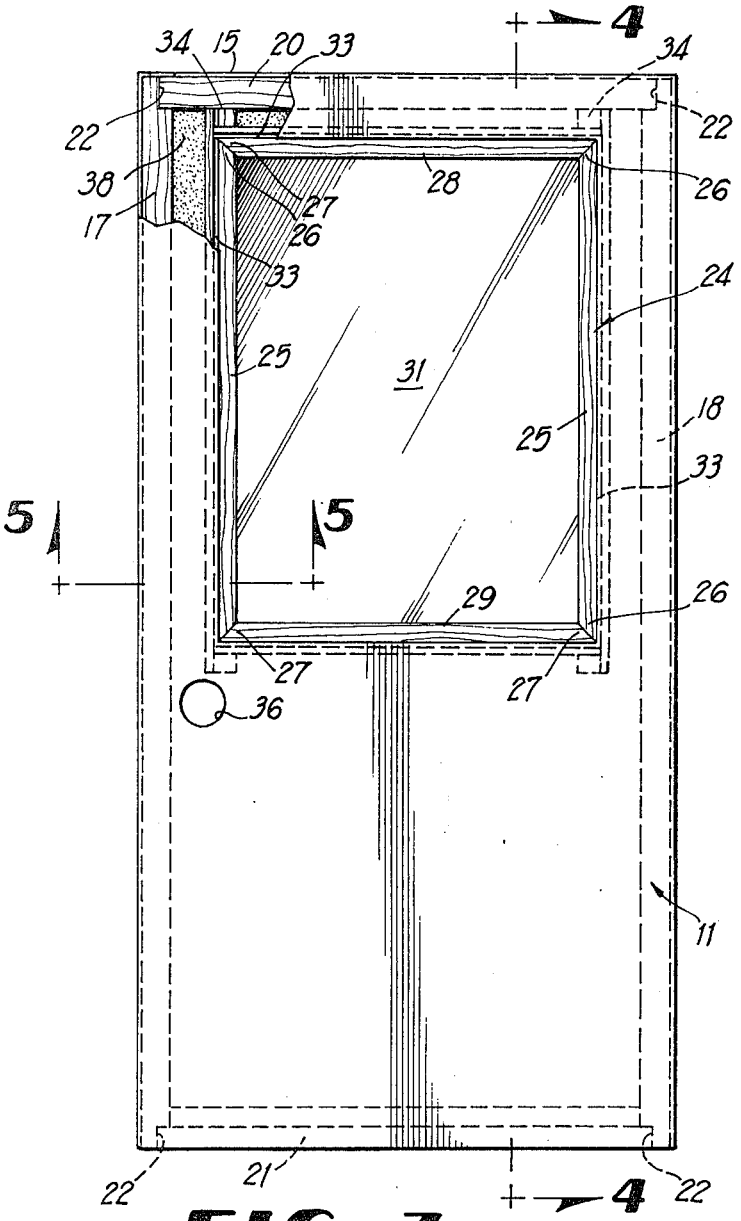
FIG. 3 is a side elevational view, partly broken away, of a completed door panel with lite assembly installed in accordance with the invention.

The prefabricated lite assembly 24 thus constructed can now be placed in position between the two steel skins 10 and 11 prior to foaming the door panel. When this is done, the flanges 13 and 14 surrounding the door skin openings engage positively and lockingly within grooves 33 formed in the forward and rear faces of all of the lite assembly frame members 25 and 28 and 29. This engagement of the flanges 13 and 14 within grooves of the lite assembly frame locks the assembly 24 against movement relative to other parts of the door panel in all directions. Additionally, as best shown in FIG. 3, the short top extensions 34 of lite frame side members 25 project above member 28 and abut the bottom of top rail 20 for further stability. Also, as shown in the drawings, the forward and rear faces of the lite frame members are in positive or solid engagement with the opposing faces of the two steel skins 10 and 11. This is clearly shown in FIGS. 4 and 5. The door panel is now essentially ready for the foaming operation.

A lock set dam or sleeve 35 is installed in lock set openings 26 of the two steel skins. Foam receptor openings 37 are provided preferably near the ends of top rail 20, as shown in FIG. 1. Foam material is now introduced to the internal cavity of the door panel between the two skins 10 and 11 and around the wooden frame of the prefabricated lite assembly 24. This frame serves as a dam to prevent foam from entering the lite space and the internal cavity quickly fills up with foam to produce a solid interior lightweight insulating foam core 38, as required in metal skinned entry doors. The door panel, after the foaming process, is complete and ready for storing prior to usage.

The greatest advantage in the above method of constructing the entry door panel is the complete elimination of the need for the prior art preliminary box-like dam which is used to keep the foam out of the lite space during the foaming operation, and the need for subsequently constructing in the lite space after the foaming procedure by a rather clumsy, costly and time-consuming procedure a glass panel or lite with caulking as discussed previously herein.

Figures 2, 6:
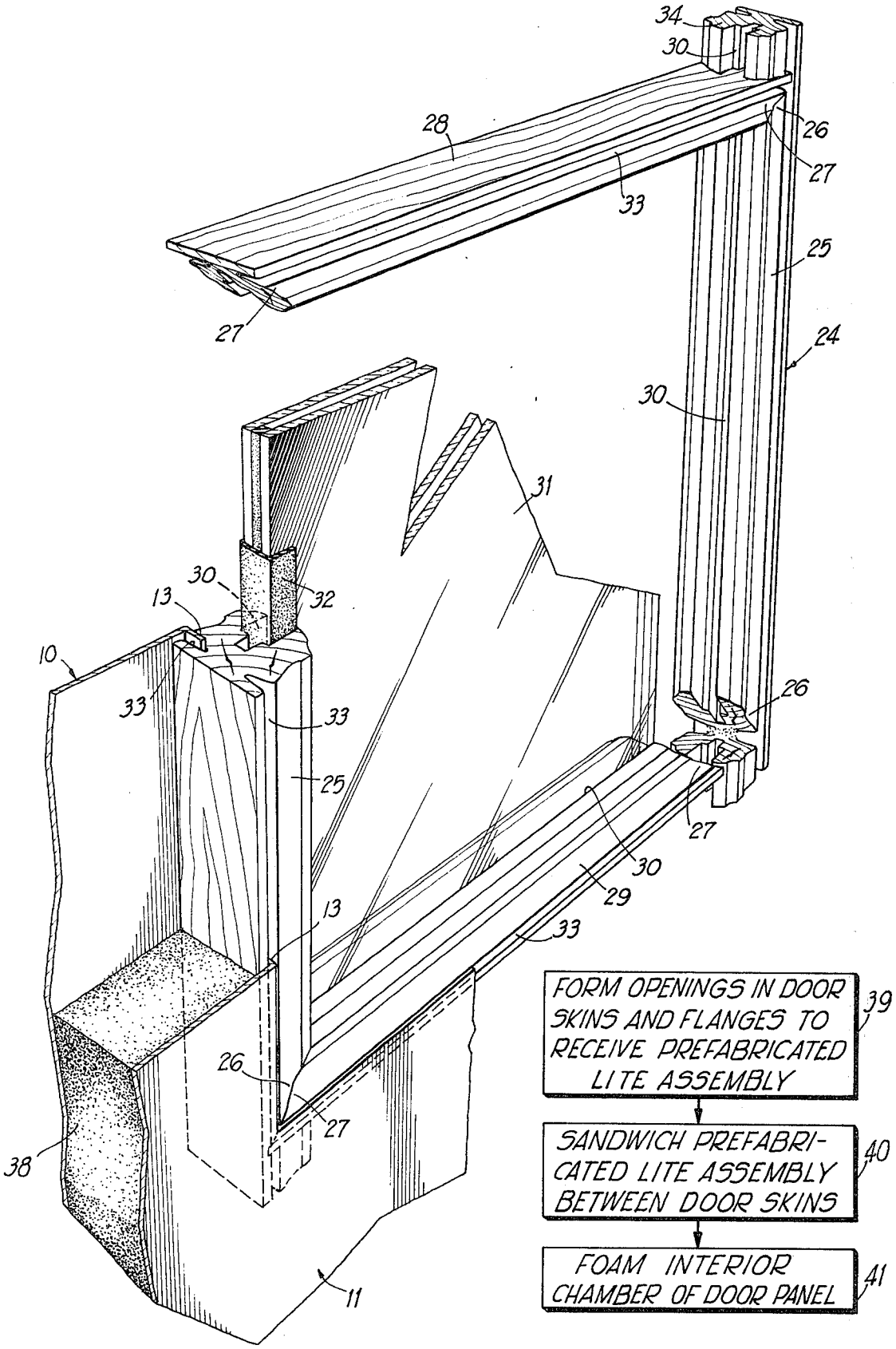
FIG. 2 is a fragmentary perspective view of a prefabricated door lite assembly and method of installation.
FIG. 6 is a flow chart of the method involved in the manufacture of the door.

The method in the invention is more direct and more economical and results in a batter product. The flow chart in FIG. 6 illustrates the three basic method steps in fabricating the metal skinned foamed entry door panels having prefabricated lite assemblies which are foamed in situ while serving as a dam. The first step 39 in FIG. 6 is the punching of openings and formation of flanges 13 and 14 around the lite openings in the steel skins 10 and 11. The second step 40 is the sandwiching or placement of the prefabricated lite assembly 24 between the steel skins in locked relation therewith. The third and final method step 41 is the foaming of the interior chamber of the hollow door panel to complete it.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An entry door panel comprising a pair of opposing metal door skins having registering lite openings and having integral flanges around the margins of said openings projecting inwardly from the planes of said skins at right angles thereto, said skins having laterally opposing continuous inwardly opening integral channels along their vertical edges from top-to-bottom of the skins and disposed on the interior sides of the skins, the skins having integral right angular inwardly projecting horizontal flanges at least across their top edges, a marginal wood frame for the door panel including vertical stiles and top and bottom rails, said stiles having exterior side continuous parallel grooves receiving interior side flanges of said channels lockingly with the channels closely surrounding the corners of the frame stiles, at least the top rail of said wood frame having shallow recesses receiving said horizontal flanges therein, a prefabricated lite assembly comprising a lite panel and a surrounding lite panel frame locked thereto, the opposite faces of the lite panel frame having receptor grooves therein receiving said flanges of said skins around the margins of said openings lockingly, the interior opposing faces of the skin abutting the opposite faces of the marginal wood frame for the door panel and the lite panel frame, such frames being of the same thickness between said skins, and a core of foam material filling the space between said skins and surrounding the lite panel frame and inside of the marginal wood frame for the door panel.

* * * * *